US006143428A

United States Patent [19]

Bommer et al.

[11] Patent Number: 6,143,428

[45] Date of Patent: Nov. 7, 2000

[54] ANTI-CORROSION COATING FOR MAGNESIUM MATERIALS

[75] Inventors: Heike Bommer, Woerth; Felix Nitschkè, Munich, both of Germany

[73] Assignee: DaimlerChrysler AG, Stuttgart, Germany

[21] Appl. No.: 09/355,240

[22] PCT Filed: Jan. 15, 1998

[86] PCT No.: PCT/DE98/00119

§ 371 Date: Jul. 26, 1999

§ 102(e) Date: Jul. 26, 1999

[87] PCT Pub. No.: WO98/32896

PCT Pub. Date: Jul. 30, 1998

[30] Foreign Application Priority Data

Jan. 28, 1997 [DE] Germany ..... 197 02 953

[51] Int. Cl.[7] ..... B32B 15/01

[52] U.S. Cl. ..... 428/649; 428/636; 428/650; 428/660; 428/933

[58] Field of Search ..... 428/649, 650, 428/636, 660, 933; 420/405, 406, 407, 410, 413, 414, 402, 417, 422, 528

[56] References Cited

U.S. PATENT DOCUMENTS

| | | | |
|---|---|---|---|
| 2,011,613 | 8/1935 | Brown et al. | 428/649 |
| 3,179,504 | 4/1965 | Bothwell | 428/649 |
| 3,900,296 | 8/1975 | Kuchek | 428/649 |
| 4,770,946 | 9/1988 | Yamauchi et al. | 428/626 |

FOREIGN PATENT DOCUMENTS 4-297542 10/1992 Japan .

*Primary Examiner*—Deborah Jones
*Assistant Examiner*—Robert R. Koehler
*Attorney, Agent, or Firm*—W. F. Fasse; W. G. Fasse

[57] ABSTRACT

Magnesium materials or components made of magnesium materials are protected against corrosion by a surface coating made of an alloy. The protective alloy coating contains a base alloy component A and at least one additive alloying component B. The base alloy component A is either titanium, or zirconium or magnesium. The alloying component B is selected from the following group: alkali metals, alkaline earth metals, rare-earth metals, yttrium, metals of the groups IIb, IIIa, IVa, and Va of the fourth or higher period of the periodic table of elements, and manganese.

4 Claims, No Drawings

ANTI-CORROSION COATING FOR MAGNESIUM MATERIALS

FIELD OF THE INVENTION

Bodies of magnesium materials are protected against corrosion by a coating layer made of an alloy that contains titanium or zirconium or magnesium as an alloy base metal and certain metal additives.

BACKGROUND INFORMATION

Magnesium materials are important light weight structural materials in vehicle technology, in engine construction, in aviation and space technology and in any other light weight construction. Due to the low specific weight of magnesium combined with very good strength characteristics, a noticeable weight reduction of the structural magnesium components is possible compared to aluminum or steel components. Compared to aluminum materials magnesium alloys have a noticeably better castability, which leads to a reduction in process steps and in an increase in productivity. Particularly, it is possible, in contrast to aluminum materials, to produce very complex, thin walled magnesium components while casting high production numbers. The use of magnesium materials in transporting means opens a high potential for cost reduction, fuel saving and payload increase.

The energy required for the primary production of magnesium is quite competitive compared with the energy required for the primary production of aluminum. In connection with re-use of magnesium only 5% of the energy needed for the primary production are required. Recycling concepts as employed for aluminum materials would thus lead to an significant reduction of the energy costs in connection with magnesium materials. However, even if no recycling is performed, it is easy to introduce magnesium materials back into the natural cycle of valuable materials.

However, the corrosion characteristic of magnesium materials is seen as a hindrance to their use. Water containing corrosive media primarily halogenate containing aqueous corrosion media can substantially influence the function of components made of magnesium. Due to this magnesium characteristic, the reluctance to use magnesium materials, particularly in aviation and space technology is very high. Even in vehicle technologies the corrosion characteristic of components subject to high loads and critical to safety plays a decisive role for example for crush elements.

Magnesium is a so-called "valve metal" which means it is capable of passivating itself. However, the passivating characteristic of magnesium is for example not as good as that of aluminum, because the grid structure of the magnesium hydroxide layer forming itself is geometrically smaller than the grid structure of the magnesium metal, whereby the protection layer can rip open. The natural passivating or protection layer of the magnesium is hardly stable against the attack of aggressive ions such as chlorides, because the chlorides can enter into the passivating layer thereby increasing its solubility.

In order to increase the corrosion resistance of magnesium structural components it is known to provide these components with so-called conversion layers in which cromates (VI) ions are embedded into the surface of the structural components. Further, an anodizing of the magnesium components is performed for example with the so-called "Magoxide" method. However, the conversion layers and the anodizing of the structural magnesium component lead only to a passivation of the component surface. This means that damage to the passivated surface layer causes the corrosion protection layer to fail at the point of damage of the magnesium structural component. The same problem occurs in connection with insulations such as organic coatings or insulation rings which are also used as corrosion protection for magnesium materials.

U.S. Pat. No. 4,770,946 discloses a magnesium material having, in addition to an oxide layer applied to the material, two resin layers and two metal layers forming a corrosion protection layer.

Japanese Patent Publication 4-297542 discloses a fiber reinforced composite magenesium material to which is applied a titanium or aluminim layer for corrosion protection purposes.

Particularly cathodic contaminations such as iron, nickel and copper have an adverse influence on the corrosion characteristic of magnesium materials. The amount of cathodic contaminations has been reduced to a minimum since the development of highly pure magnesium alloys. However, these elements can be present as a contamination of the component surface during manufacture and during working of the magnesium component for example due to chips or wear of the machining tool. Further, due to its position in the electro-chemical voltage series, magnesium tends to form contact corrosion with all metallic structural materials.

SUMMARY OF THE INVENTION

It is the object of the invention to provide a magnesium material with a corrosion protection layer, which is self-healing and which has an electrolytic protection effect.

This object has been achieved according to the invention by a corrosion protection layer made of a corrosion protection alloy composed of at least one alloy base metal and an alloying component. The alloy base metal is selected from the group of titanium, zirconium, or magnesium. The alloying component is at least one additive metal selected from the group consisting of alkali metals, alkaline earth metals, rare earth metals, yttrium, metals from groups 12 to 15 of the fourth or a higher period of the periodic system of elements and manganese, wherein the proportion of the additive metal or metals in the alloy is within the range of 0.2 to 15% by weight. If the alloy base metal is magnesium, at least 5% by weight of titanium and/or zirconium are added to the corrosion protection alloy.

According to the invention, the structural component of magnesium which is to be protected against corrosion, is provided with a metallic corrosion protection layer. The corrosion protection layer is formed by an alloy, which, on the one hand, is made of a base metal (A) and, on the other hand, of at least one additive metal (B).

The base metal (A) consists of at least one metal selected from the group of titanium, zirconium or magnesium. The base metal can consist of titanium, or zirconium or magnesium metal or it may be an alloy of two or more metals of this group.

If magnesium is used for the base material of the corrosion protection layer it is in the form of a magnesium alloy.

The proportion of the additive metal or metals from the group titanium and zirconium in the magnesium alloy amounts to at least 5% by weight.

Due to the use of titanium or zirconium material or a magnesium alloy which contains at least 5% of the metals titanium and zirconium for the base material, the corrosion protection layer according to the invention has an excellent passivity. Such passivity means that the corrosion current density of the corrosion protection layer is smaller than that of the magnesium material to be protected and that the pitting corrosion potential is increased. Thus, the corrosion protection layer according to the invention comprises due to the base material inherently a high corrosion resistance.

DETAILED DESCRIPTION OF PREFERRED EXAMPLE EMBODIMENTS AND OF THE BEST MODE OF THE INVENTION

One or more of the additive metals (B) that are added to the base material of the corrosion protection layer according to the invention is/are selected from the following group:

alkali metals, alkaline earth metals, rare earth metals, yttrium, metals of groups 12 to 15 of the fourth or higher period of the periodic system of elements and manganese.

The additive metals (B) belong into two subgroups, namely:

a first subgroup (i) including alkali metals, alkaline earth metals, rare earth metals and yttrium;

and additive metals of a second subgroup (ii), namely metals of the groups 12 to 15 of the fourth or higher period of the periodic system of elements and manganese.

The alkali metals and the alkaline earth metals of the first subgroup (i) comprise particularly lithium, sodium and potassium or calcium. In case the base material of the corrosion protection layer is titanium or zirconium material it is possible that the additive metal of the first subgroup is magnesium.

The following metals of the second subgroup (ii) of additive metals include particularly zinc, cadmium, mercury, gallium, indium, thallium, germanium, tin, lead, arsenic, antimony, bithmuth, and manganese. These are so-called sp-metals which means metals whose outer s-states or p-states of the electron configuration are not filled up.

The additive metals of the first subgroup (i) have a lower quiescent potential than the magnesium material to be protected. This means that these additive metals shift the quiescent potential of the corrosion protection layer below that of the magnesium material, thereby leading to a cathodic corrosion protection of the magnesium material to be protected in case the corrosion protection layer should be damaged. The additive metals of the second subgroup (ii) lead to a high hydrogen excess voltage (hydrogen evolution overvoltage) which poisons the cathodic partial reaction, that is, it prevents such reaction. These additive metals thus function also as poisoning of the cathodic reaction. Since the quiescent potential of magnesium is in the range of hydrogen reduction it is necessary to prevent the hydrogen reduction in order to reduce the cathodic partial reaction. The bonding of the hydrogen to the metal surface plays a decisive role in this connection.

The base material of the corrosion protection layer is alloyed with at least one additive metal of the first subgroup (i) and at least one additive metal of the second subgroup (ii) in order to reduce the quiescent potential of the corrosion protection layer and in order to assure a high hydrogen excess voltage (hydrogen evolution overvoltage) of the protection layer.

The proportion of the additive metal or metals in the corrosion protection layer according to the invention amounts to 0.2 to 15% by weight. In case one or more additive metals of the first subgroup (i) having a negative quiescent potential, are used in combination with one or several additive metals of the second group (ii) having a high hydrogen excess voltage (hydrogen evolution overvoltage), the proportion of the additive metal or metals with a negative quiescent potential in the alloy amounts to a total of at least 0.2% by weight, and the proportion of the additive metal or metals having the high hydrogen excess voltage (hydrogen evolution overvoltage) in the alloy amounts to a total of at least 0.2% by weight, preferably 2% by weight.

Thus, in the corrosion protection layer according to the invention the cathodic corrosion protection is combined, due to the additive metals, with the inherent passivity of the base material in order to obtain with the corrosion protection layer a magnesium material having an optimal corrosion resistance. The metals of the base material and of the additive metals function out of the alloy. Thus, the corrosion protection layer according to the invention has a self-healing effect and an electrolytic protection action.

The additive metals may form cathodic precipitations at which preferably the water reduction occurs. The additive metals of the first group (i) are finely disbursed and even the additive metals of the group (ii) may be finely disbursed.

The corrosion protection layer according to the invention is particularly suitable for magnesium materials which are exposed to an aqueous corrosion medium particularly an aqueous corrosion medium containing a halogenide.

The magnesium material to be protected by the corrosion protection layer according to the invention is particularly formed of highly pure magnesium, that is magnesium which particularly does not contain any iron, nickel or copper.

The corrosion protection layer according to the invention which is applied to the magnesium material to be protected or applied to the magnesium component to be protected, may be applied as a coating to the magnesium material or it may be formed on a surface area of the magnesium material.

The application of the corrosion protection layer according to the invention as a coating can for example take place by flame spraying or plasma spraying or by sputtering. The formation of the corrosion protection layer according to the invention on a surface area of the magnesium material can be performed for example by coating the casting mold prior to pouring the magnesium or by co-extrusion or by plating. The thickness of the corrosion protection layer according to the invention should be at least 5 micrometer ($\mu$m), preferably at least 0.2 mm.

EXAMPLE

An electro-chemical cell was used. The bottom of the cell was made of a pressure cast plate from which a disk was stamped to have a diameter of about 5 cm and a layer thickness of 2 mm. The pressure cast plate consisted of a magnesium material AM50A (up to 5.4% of Al, 0.26 to 0.6% of Mn, 0.22% of Zn, 0.10% of Si, 0.010% of Cu, 0.002% of Ni, and maximally 0.004% of Fe, remainder Mg). A cylindrical sample having a diameter of about one cm and a length of about one cm was arranged in the cell spaced from the bottom of the cell. The cylindrical sample is provided with an axial bore into which a wire was screwed. The wire was connected to a disk of AM50A through a high ohmic potentiometer. The electro-chemical cell was filled with an electrolyte including 120 ppm chloride (NaCl). The contact corrosion current density was measured for two days with a potentiometer.

The cylindrical samples were made of the following alloys:

a) 0.84% by weight of Mn/remainder Mg b) 3.0% by weight of Pb/remainder Mg c) 3.1% by weight of Pb/remainder Mg d) 3% by weight of In/remainder Mg.

The average contact corrosion current density measured with the probes over two days were as follows:

a) −0.4 mA/cm$^2$ b) −0.5 mA/cm$^2$ c) −0.7 mA/cm$^2$ d) −2.0 mA/cm$^2$.

The AM50A magnesium material is cathodically protected against corrosion by the respectively measured negative contact corrosion current density.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A magnesium material to be protected comprising a corrosion protection layer made of a corrosion protection alloy composed of at least one alloy base metal and an alloying component, wherein said at least one alloy base metal is selected from the group consisting of titanium, zirconium, and magnesium, wherein said alloying component is at least one additive metal selected from the group consisting of alkali metals, alkaline earth metals, rare earth metals, yttrium, metals from groups 12 to 15 of the fourth or a higher period of the periodic system of elements and manganese, wherein the proportion of the additive metal or metals in the corrosion protective alloy is within the range of 0.2 to 15% by weight, and wherein said corrosion protection alloy based on magnesium contains at least 5% by weight of a metal selected from the group consisting of titanium and zirconium.

2. The magnesium material of claim 1, wherein said at least one additive metal of said corrosion protection alloy has a quiescent potential that is more negative than a quiescent potential of said magnesium material to be protected, said at least one additive metal being selected from the group consisting of alkali metals, rare earth metals, yttrium and at least one further additive metal having a high hydrogen evolution overvoltage, said at least one further additive metal being selected from the group consisting of metals from groups 12 to 15 of the fourth or of a higher period in the periodic system and manganese.

3. The magnesium material of claim 2, wherein said at least one alloy base metal is selected from the group consisting of titanium and zirconium, and wherein said corrosion protection alloy has said more negative quiescent potential than the magnesium material to be protected and includes magnesium.

4. The magnesium material of claim 2, wherein said at least one additive metal having said more negative quiescent potential than the magnesium material to be protected is present as an alloy proportion of at least 0.2% by weight, and wherein said at least one further additive metal having said high hydrogen evolution overvoltage is present as a further alloy proportion of at least 0.2% by weight.

* * * * *